US010161399B2

(12) United States Patent
Schofield

(10) Patent No.: US 10,161,399 B2
(45) Date of Patent: Dec. 25, 2018

(54) SCROLL PUMP

(71) Applicant: Edwards Limited, Crawley, Sussex (GB)

(72) Inventor: Nigel Paul Schofield, Horsham (GB)

(73) Assignee: Edwards Limited, Burgess Hill (GB)

( * ) Notice: Subject to any disclaimer, the term of this patent is extended or adjusted under 35 U.S.C. 154(b) by 251 days.

(21) Appl. No.: 14/411,701

(22) PCT Filed: Jun. 10, 2013

(86) PCT No.: PCT/GB2013/051516

§ 371 (c)(1),
(2) Date: Dec. 29, 2014

(87) PCT Pub. No.: WO2014/006363

PCT Pub. Date: Jan. 9, 2014

(65) Prior Publication Data

US 2015/0176584 A1 Jun. 25, 2015

(30) Foreign Application Priority Data

Jul. 6, 2012 (GB) ..... 1212018.4

(51) Int. Cl.
*F04C 18/02* (2006.01)
*F04C 27/00* (2006.01)
*F01C 19/08* (2006.01)

(52) U.S. Cl.
CPC ..... *F04C 27/005* (2013.01); *F01C 19/08* (2013.01); *F04C 18/0215* (2013.01); *F04C 27/008* (2013.01); *F04C 2240/807* (2013.01)

(58) Field of Classification Search
CPC .. F04C 18/0215; F04C 27/005; F04C 27/008; F01C 19/08

(Continued)

(56) References Cited

U.S. PATENT DOCUMENTS 5,258,046 A * 11/1993 Haga ..... F01C 1/0223 418/142
6,592,345 B2 * 7/2003 Suefuji ..... F04C 27/008 418/55.4

(Continued)

FOREIGN PATENT DOCUMENTS

CN 101163884 A 4/2008
CN 102312834 A 1/2012

(Continued)

OTHER PUBLICATIONS

Combined Search and Examination Report under Sections 17 and 18(3) dated Nov. 7, 2012 in counterpart GB Application No. GB1212018.4, 5 pgs.

(Continued)

*Primary Examiner* — Mary A Davis
*Assistant Examiner* — Deming Wan
(74) *Attorney, Agent, or Firm* — Shumaker & Sieffert, P.A.

(57) ABSTRACT

The present invention provides a scroll pump comprising: a scroll mechanism having an orbiting scroll and a fixed scroll; a drive shaft having a concentric shaft portion and an eccentric shaft portion connected to the orbiting scroll. The shaft is arranged to be driven by a motor so that rotation of the shaft imparts an orbiting motion to the orbiting scroll relative to the fixed scroll for pumping fluid along a flow path from an inlet to an outlet of the scroll mechanism. An axial lip seal is located between the orbiting scroll and the fixed scroll for resisting leakage of fluid from outside the scroll mechanism into the flow path.

15 Claims, 2 Drawing Sheets

(58) Field of Classification Search
USPC ..... 418/55.1–55.6, 60, 142, 143, 186–188
See application file for complete search history.

(56) References Cited

U.S. PATENT DOCUMENTS

| | | | | |
|---|---|---|---|---|
| 7,614,860 | B2 | 11/2009 | Yano et al. | |
| 8,128,388 | B2 * | 3/2012 | Shimoji | F01C 1/0223 418/270 |
| 2006/0029508 | A1 * | 2/2006 | Fujioka | F04C 23/001 418/55.1 |
| 2008/0101973 | A1 * | 5/2008 | Iwano | F04C 18/0215 418/55.1 |
| 2008/0193313 | A1 | 8/2008 | Sekiya et al. | |
| 2009/0123315 | A1 * | 5/2009 | Nakamura | F04C 18/0223 418/55.1 |
| 2012/0009077 | A1 | 1/2012 | Iwano et al. | |

FOREIGN PATENT DOCUMENTS

| | | | |
|---|---|---|---|
| EP | 1867834 | A2 | 12/2007 |
| EP | 1870598 | A1 | 12/2007 |
| JP | 200073969 | A | 3/2000 |
| JP | 2000337275 | A | 12/2000 |
| JP | 2003065262 | A | 3/2003 |
| JP | 4821612 | B2 | 11/2011 |
| WO | 2011135324 | A3 | 11/2011 |

OTHER PUBLICATIONS

Notification of Transmittal of the International Search Report and the Written Opinion of the International Searching Authority, or the Declaration, dated Jul. 30, 2013 in counterpart International Application No. PCT/GB2013/051516, 9 pgs.

First Office Action, and translation thereof, from counterpart Chinese Patent Application No. 201380036028.4, dated Feb. 22, 2015, 19 pp.

Notification of Reason for Rejection, and translation thereof, from counterpart Japanese Application No. 2015-519322, dated Mar. 23, 2017, 7 pp.

Examination Report from counterpart European Application No. 13728812.2, dated Aug. 8, 2018, 5 pp.

* cited by examiner

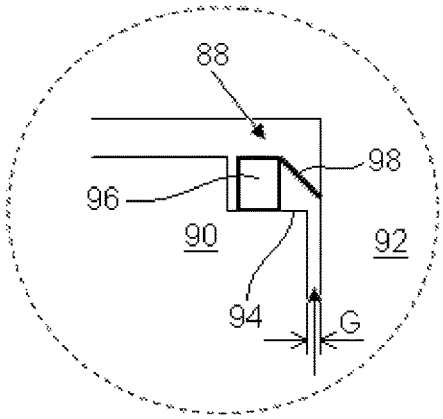
FIG. 2
FIG. 3
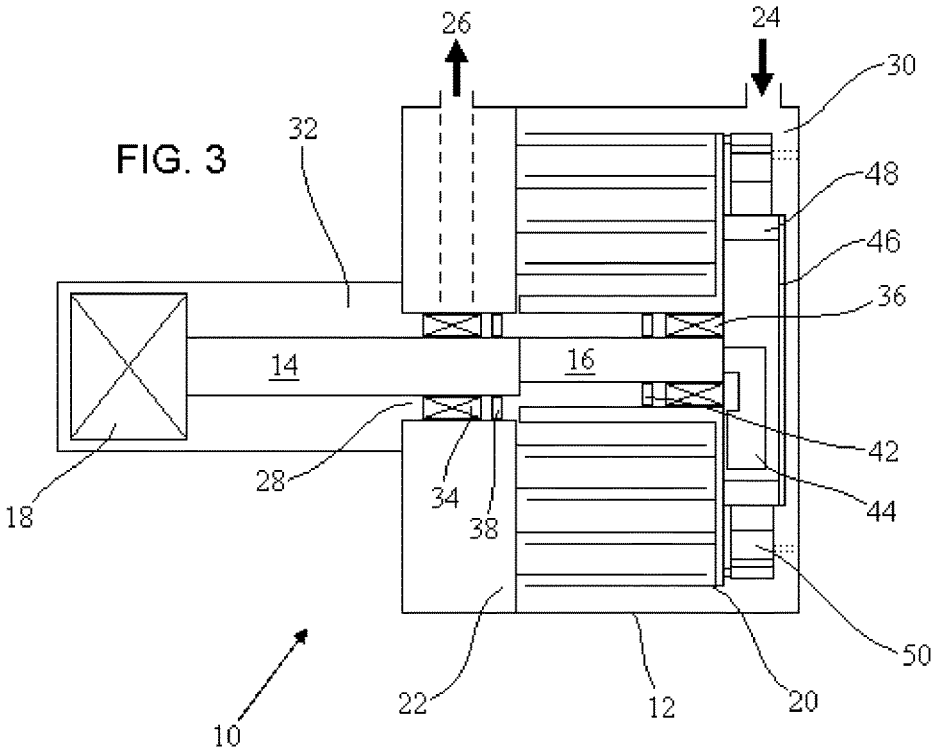

SCROLL PUMP

This application is a national stage entry under 35 U.S.C. § 371 of International Application No. PCT/GB2013/051516, filed Jun. 10, 2013, which claims the benefit of G.B. Application 1212018.4, filed Jul. 6, 2012. The entire contents of International Application No. PCT/GB2013/051516 and G.B. Application 1212018.4 are incorporated herein by reference.

TECHNICAL FIELD

The present invention relates to a scroll pump, which is often referred to as a scroll compressor.

BACKGROUND

A known scroll compressor, or pump, 10 is shown in FIG. 3 and described in more detail in the present applicant's earlier application WO2011/135324. The pump shown in FIG. 3 has an inverted scroll configuration. The pump 10 comprises a pump housing 12 and a drive shaft 14 having an eccentric shaft portion 16. The shaft 14 is driven by a motor 18 and the eccentric shaft portion is connected to an orbiting scroll 20 so that during use rotation of the shaft imparts an orbiting motion to the orbiting scroll relative to a fixed scroll 22 for pumping fluid along a fluid flow path between a pump inlet 24 and pump outlet 26 of the compressor. The fixed scroll is shown generally on the left and the orbiting scroll is shown generally on the right. The fixed scroll comprises an opening 28 through which the shaft 14 extends and is connected to the orbiting scroll 20 on an opposing side of the fixed scroll to the motor 18. A high vacuum region 30 is located at the inlet 24 and a low vacuum, or atmospheric, region 32 is located at the outlet 26.

A counter-weight 44 balances the weight of the orbiting components of the pump, including the orbiting scroll 20, the second bearing 36 and the eccentric portion 16 of the drive shaft. The orbiting scroll 20 constitutes the majority of the weight of the orbiting components and its centre of mass is located relatively close to the scroll plate of the orbiting scroll. A cap 46 is fixed to a raised seat 48 of the orbiting scroll and seals low vacuum region, containing the counter-weight and the bearings 34, 36 from the high vacuum region 30.

An anti-rotation device 50 is located in the high vacuum region 30 of the pump and is connected to the orbiting scroll 20 and the housing 12. The anti-rotation device resists rotation of the orbiting scroll but allows orbiting motion of the orbiting scroll. The anti-rotation device is lubricant free and in this example is made from a plastics material, and may be a one-piece polymer component as described in greater detail in the earlier application.

A first bearing 34 supports the concentric portion of the drive shaft 14 for rotation. The bearing 34 is fixed relative to the housing or as shown the fixed scroll 22. A second bearing 36 connects the eccentric portion 16 of the drive shaft to the orbiting scroll 20 allowing angular movement of the orbiting scroll relative to the eccentric portion. A first shaft seal 38 is located between the fixed scroll 22 and the concentric portion 14 of the shaft resists the passage of lubricant from first bearing 34 and gas from the atmospheric side of the pump towards the low pressure side of the pump or into the flow path between the inlet and outlet. A second shaft seal 42 is located between the orbiting scroll 20 and the eccentric portion 16 of the shaft and resists the passage of lubricant from second bearing 36 into the flow path between the inlet and outlet.

Generally there is a desire to produce smaller pumps. The inverted scroll pump provides a more compact solution compared to a non-inverted scroll pump. In the inverted solution the shaft seals described above are used to seal between the shaft and the orbiting scroll and the shaft and the fixed scroll. Scroll pumps are typically caused to rotate at about 1500 rpm but as pumps become smaller there is a requirement to rotate the drive shaft more quickly at speeds of for example 1800 rpm to maintain similar pumping performance. Generally, the shaft seals wear quite quickly and require regular replacement and this problem is exacerbated at higher speeds. A harder seal could be used and may last longer but will seal less effectively.

SUMMARY

The present invention provides an improved scroll pump.

The present invention provides a scroll pump comprising: a scroll mechanism having an orbiting scroll and a fixed scroll; a drive shaft having a concentric shaft portion and an eccentric shaft portion connected to the orbiting scroll, the shaft being arranged to be driven by a motor so that rotation of the shaft imparts an orbiting motion to the orbiting scroll relative to the fixed scroll for pumping fluid along a flow path from an inlet to an outlet of the scroll mechanism, wherein an axial lip seal is located between the orbiting scroll and the fixed scroll for resisting leakage of fluid from outside the scroll mechanism into the flow path.

Other preferred and/or optional aspects of the invention are defined in the accompanying claims.

BRIEF DESCRIPTION OF DRAWINGS

In order that the present invention may be well understood, an embodiment thereof, which is given by way of example only, will now be described with reference to the accompanying drawings, in which:

FIG. 2 shows an enlarged view of a sealing arrangement of the scroll pump; and FIG. 3 shows a first prior art scroll pump.

DETAILED DESCRIPTION

Figure 1:
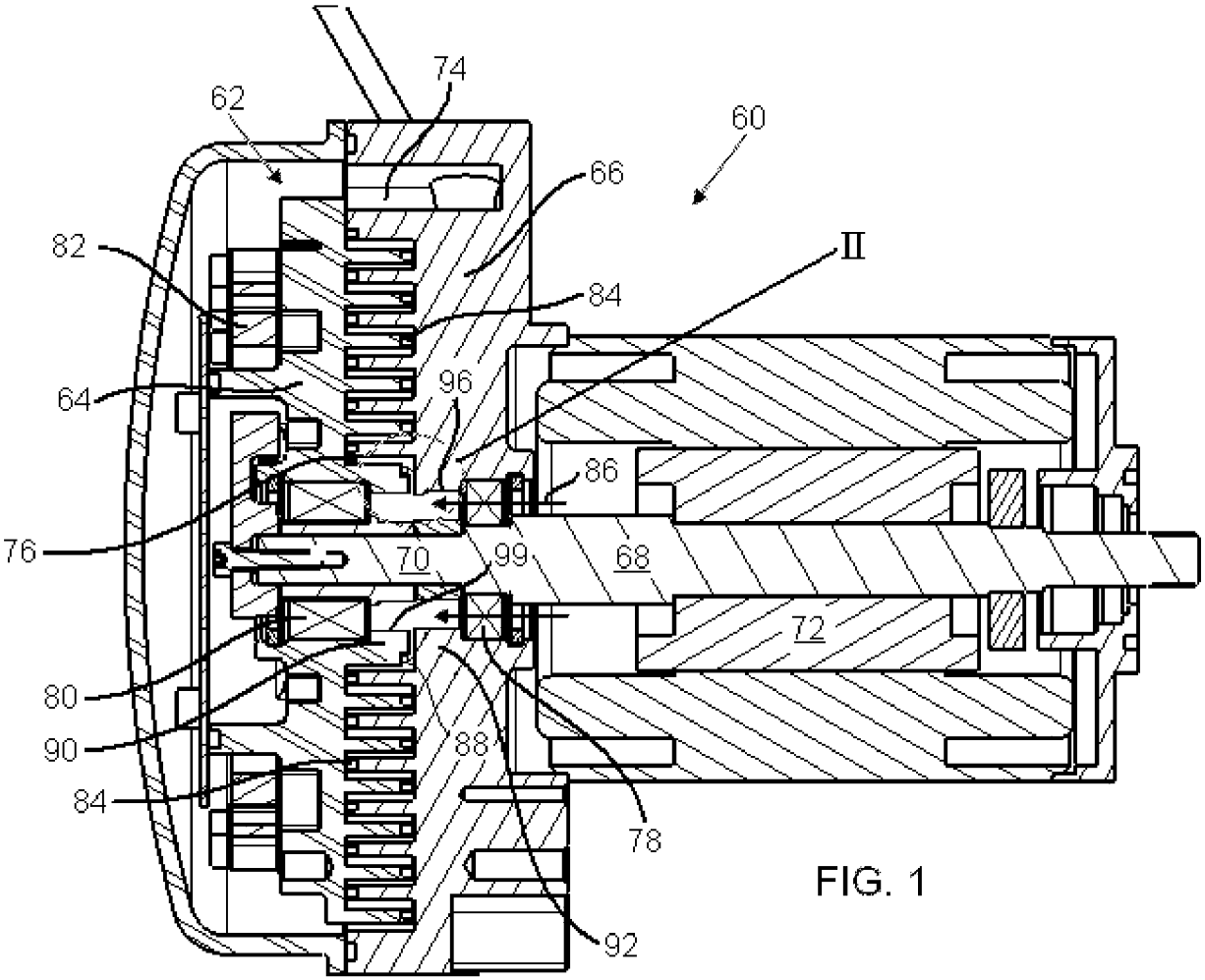
FIG. 1 shows a scroll pump.

Referring to FIG. 1, a scroll pump 60 is shown which is similar in structure to the known inverted scroll pump described in relation to FIG. 3. Only those features of the scroll pump 60 which differ from the known scroll pump will be described in detail.

Similarly to the known scroll pump, scroll pump 60 comprises a scroll mechanism 62 having an orbiting scroll 64 and a fixed scroll 66. A drive shaft has a concentric shaft portion 68 and an eccentric shaft portion 70 connected to the orbiting scroll. The shaft is arranged to be driven by a motor 72 so that rotation of the shaft imparts an orbiting motion to the orbiting scroll relative to the fixed scroll.

Relative orbiting motion of the scrolls pumps fluid along a flow path from an inlet 74 to an outlet 76 of the scroll mechanism. The inlet is located at a radially outer portion of the mechanism and the outlet is located at a radially inner portion of the mechanism.

A first bearing 78 is located between the fixed scroll and the concentric portion 68 of the shaft and supports the shaft for rotation by the motor 72. The first bearing may be a lubricated rolling bearing. A second bearing 80 is located between the orbiting scroll and the eccentric portion 70 of the shaft and supports the orbiting scroll for orbiting rotation. The anti-rotation device 82 prevents rotation of the orbiting scroll but allows lateral translation in two orthogonal dimensions such that rotation of the shaft causes the required orbiting motion.

During relative orbiting motion of the scrolls, fluid is pumped from the inlet 74 to the outlet 76 of the scroll mechanism along a flow path that extends between the scroll walls following a generally involute path. In the context of scroll pumps, each full circumference along the flow path is referred to as a wrap and the flow path extends from an outer wrap adjacent the inlet to an inner wrap adjacent the outlet. Since fluid is compressed as it travels in pockets along the involute path it is necessary to seal between adjacent wraps to prevent leakage from a higher pressure pocket to a lower pressure pocket and sealing is typically achieved with tip seals. Tip seals are known in the art and are seated at the axial end portions of the scroll walls of both the orbiting scroll and the fixed scroll and indicated by reference 84 in FIG. 1. The tips seals are dynamic seals and are designed to seal between adjacent wraps during relative orbiting motion of the scrolls when the pump is in operation. In addition to leakage across the scroll walls between adjacent wraps, leakage may occur from atmosphere into the flow path as shown by arrows 86 in FIG. 1. When the pump is in operation the pressure in the inner wrap of the scroll mechanism is high and may be around 800 mbar for example. Accordingly, the pressure differential from gas flow 86 at 1000 mbar to the 800 mbar in the inner wrap is relatively low and may be resisted by the tip seals in the known arrangement. However, when the pump is stopped, there is an immediate reduction in pressure to around 50 mbar causing a pressure differential of 1000 mbar to 50 mbar. This reduction in pressure occurs because gas trapped in the scroll pump expands into the high vacuum region. There is an exhaust valve that prevents atmospheric gas flowing back into the pump and raising the pressure. The tip seals are prone to leakage at these pressure differentials. In the known mechanism, the leakage of gas as indicated by arrows 86 is resisted by a shaft seal 38 which is located on an inner side of the bearing 78. Such radial shaft seals are well known in the art but as indicated above these radial seals are abraded quickly and require regular replacement because of the high rotational speeds of the shaft.

In the arrangement of FIG. 1, an axial lip seal 88 is used and located between portion 90 of the orbiting scroll and portion 92 of the fixed scroll. The portions 90, 92 of the scrolls face each other and define an axial gap therebetween which is sealed by lip seal 88. In this example the lip seal 88 is located on the orbiting scroll and seals against the opposing surface, or face, of the fixed scroll but the lip seal may be mounted on either scroll. Since portions 90, 92 orbit relative to each other, rather than rotate relative to each other, the amount of relative movement between the seal and the opposing surface of the other scroll is comparatively small. In this regard, the amount of movement of the seal relative to the opposing surface of other scroll is approximately proportional to the offset between the eccentric portion and the concentric portion of the shaft. On the other hand, in the prior art, the amount movement of the seal relative to the shaft is approximately proportional to the radius of the shaft. The radius of the shaft is much larger than the offset of the eccentric portion and therefore the lip seal in FIG. 1 is subject to less abrasion than the known shaft seal in FIG. 3. Accordingly, even when subject to high rotational speeds, particularly in smaller pumps, the axial lip seal requires replacement at tolerably low intervals.

The axial lip seal 88 is shown in simplified form in FIG. 2, which is an enlargement of region II shown in FIG. 1. As indicated above the lip seal may be mounted on either scroll but in FIG. 2 the lip seal is mounted on portion 90 of the orbiting scroll. Portion 90 has a shoulder 94 and the lip seal is fixed around the shoulder by suitable means such as an interference fit or with adhesive. The lip seal comprises a mounting portion 96 for mounting the lip seal to the orbiting scroll and lip portion 98 which seals against the portion 92 of the fixed scroll and resists leakage from atmosphere through gap G in the direction of the arrow. Gas leakage in the direction of the arrow comes from a region defined by openings in the orbiting scroll and the fixed scroll, and flows in all radial directions (i.e. not only the direction shown in FIG. 2). In this regard, in this inverted scroll configuration, the shaft extends through an opening 96 in the fixed scroll and an opening 99 in the orbiting scroll and is fixed to the orbiting scroll on an opposite side of the fixed scroll to the motor as shown. During operation of the pump, the openings 96, 99 are at or close to atmosphere due to leakage of gas from the high pressure side of the pump and around bearing 78 in the direction of arrows 86 in FIG. 1. The axial lip seal resists leakage of gas from the openings into the flow path in the direction of the arrow shown in FIG. 2. When the pump is stopped the pressure differential across the lip seal can be around 1000 mbar to 50 mbar, as indicated above. The relatively high pressure on the atmospheric side of the lip seal causes the lip seal to be pressed against the opposing scroll thereby increasing the sealing force. Accordingly, the present arrangement seals against leakage even at high pressure differentials.

Furthermore, as the bearings 78, 80 are typically lubricated, the axial lip seal is configured to resist the leakage of lubricant, in addition to gas, from the bearings into the flow path.

Referring to both FIGS. 1 and 2, the lip seal 88 is located inward from the tip seals 84 and provides a sealing force over and above the sealing force provided by the tip seals. FIG. 1 shows the pump 60 and the lip seal 88 in section and it will be appreciated that the lip seal is annular extending around the axis of the shaft. The lip seal preferably has a generally circular configuration and is its location is such that throughout its orbiting motion relative to the opposing scroll it remains radially inward of the outlet 76 of the scroll mechanism to resist the leakage of gas into the flow path.

The invention claimed is:

1. A vacuum scroll pump comprising:

a scroll mechanism comprising an orbiting scroll and a fixed scroll;

a drive shaft comprising:

a concentric shaft portion; and an eccentric shaft portion, wherein the eccentric shaft portion is connected to the orbiting scroll;

the drive shaft is arranged to be driven by a motor so that rotation of the drive shaft imparts an orbiting motion to the orbiting scroll relative to the fixed scroll for pumping fluid along a flow path, wherein the drive shaft extends through respective openings in the fixed scroll and the orbiting scroll and is fixed to the orbiting scroll on an opposite side of the fixed scroll to the motor; and the flow path extends from an inlet of the scroll mechanism to an outlet of the scroll mechanism; and an axial lip seal, wherein the axial lip seal is:

located between the orbiting scroll and the fixed scroll;

configured to press against one of the scrolls for resisting leakage of the fluid from a higher pressure outside the scroll mechanism into a lower pressure in the flow path; and physically configured so that a sealing force between the axial lip seal, the orbiting scroll, and the fixed scroll is greater at higher pressure differentials across the axial lip seal, and wherein, during use, the openings are at or close to atmospheric pressure and the axial lip seal resists leakage of gas from the openings into the flow path.

2. The vacuum scroll pump of claim 1, wherein the axial lip seal is fixed relative to one of the orbiting scroll or the fixed scroll and seals against the other of the orbiting scroll or the fixed scroll so that an orbiting motion is imparted to the axial lip seal relative to the other scroll.

3. The vacuum scroll pump of claim 2, wherein the axial lip seal extends across an axial gap between the orbiting scroll and the fixed scroll.

4. The vacuum scroll pump of claim 3, wherein the inlet of the scroll mechanism is located at a radially outer portion of the scroll mechanism and the outlet of the scroll mechanism is located at a radially inner portion of the scroll mechanism, and wherein the axial lip seal is located radially inward from the outlet.

5. The vacuum scroll pump of claim 3, wherein the axial lip seal is annular and extends around an axis of the shaft.

6. The vacuum scroll pump of claim 2, wherein the inlet of the scroll mechanism is located at a radially outer portion of the scroll mechanism and the outlet of the scroll mechanism is located at a radially inner portion of the scroll mechanism, and wherein the axial lip seal is located radially inward from the outlet.

7. The vacuum scroll pump of claim 2, wherein the axial lip seal is annular and extends around an axis of the shaft.

8. The vacuum scroll pump of claim 1, wherein the axial lip seal extends across an axial gap between the orbiting scroll and the fixed scroll.

9. The vacuum scroll pump of claim 8, wherein the inlet of the scroll mechanism is located at a radially outer portion of the scroll mechanism and the outlet of the scroll mechanism is located at a radially inner portion of the scroll mechanism, and wherein the axial lip seal is located radially inward from the outlet.

10. The vacuum scroll pump of claim 8, wherein the axial lip seal is annular and extends around an axis of the shaft.

11. The vacuum scroll pump of claim 1, wherein the inlet of the scroll mechanism is located at a radially outer portion of the scroll mechanism and the outlet of the scroll mechanism is located at a radially inner portion of the scroll mechanism, and wherein the axial lip seal is located radially inward from the outlet.

12. The vacuum scroll pump of claim 11, wherein the axial lip seal is annular and extends around an axis of the shaft.

13. The vacuum scroll pump of claim 1, wherein the axial lip seal is annular and extends around an axis of the drive shaft.

14. The vacuum scroll pump of claim 1, further comprising a lubricated bearing arrangement, wherein the lubricated bearing arrangement is located between at least one of: (1) the fixed scroll and the concentric shaft portion, (2) the fixed scroll and the orbiting scroll, or (3) the eccentric shaft portion and the orbiting scroll, and wherein the axial lip seal resists leakage of lubricant from the lubricated bearing arrangement into the flow path.

15. The vacuum scroll pump of claim 1, wherein gas pressure in the openings acting on the axial lip seal causes an increased sealing force to be generated by the axial lip seal.

* * * * *